US005862923A

United States Patent [19]

Nordquist et al.

[11] Patent Number: 5,862,923

[45] Date of Patent: Jan. 26, 1999

[54] SELF-FACING SHELF SLIDE

[75] Inventors: Leslie M. Nordquist, Zumbrota, Minn.; Howard J. Fredrickson, Raleigh, N.C.; James E. Kovacs, Lakeville; Mark H. Sickman, Rochester, both of Minn.

[73] Assignee: Cannon Equipment Company, Cannon Falls, Minn.

[21] Appl. No.: 568,215

[22] Filed: Dec. 6, 1995

Related U.S. Application Data

[63] Continuation-in-part of Ser. No. 162,552, Dec. 3, 1993, abandoned, which is a continuation-in-part of Ser. No. 993,157, Dec. 18, 1992, abandoned.

[51] Int. Cl.[6] ..... A47F 5/00

[52] U.S. Cl. ..... 211/59.2

[58] Field of Search ..... 211/59.2, 181, 211/183, 153

[56] References Cited

U.S. PATENT DOCUMENTS 4,294,363 10/1981 Oztekin ..... 211/59.2

4,416,380 11/1983 Flum ..... 211/181 X 5,022,535 6/1991 Spamer ..... 211/59.2

*Primary Examiner*—Alvin C. Chin-Shue

*Attorney, Agent, or Firm*—Sten Erik Hakanson

[57] ABSTRACT

A shelf slide and shelf using a plurality of such slides is shown. The slides are releasably securable to wire supports used to form a display shelf. The slides are made of an extruded material having a lower coefficient of friction than the shelf wires and facilitate the movement of product on the shelf from the rear of the shelf to the front of the shelf under the force of gravity. A universal mounting device for permitting the use of a particularly sized shelf with existing shelf support framework where the existing framework is not sized to support the particularly sized shelf. An air baffle mountable on each shelf is also shown for reducing air flow around the shelves for preventing frost formation on refrigerated products.

1 Claim, 14 Drawing Sheets

108
110
106
100
114a
112
104
118
102
114
104a 108
15
106
110
15
114
112
16
118
16

106

108
112
108
114
118
110

106

114
118
112
108

SELF-FACING SHELF SLIDE

The present application is a continuation in part based upon U.S. Ser. No. 08/162,552, filed Dec. 3, 1993, abandoned, which was a continuation in part based upon U.S. Ser. No. 07/993,157 filed Dec. 18, 1992, abandoned.

BACKGROUND

1. Field of the Invention

The present invention relates to self-facing shelves and in particular to means for reducing friction between the shelf and products being displayed and sold therefrom.

2. Background of the Invention

Self-facing shelves are known and used for the display and sale of merchandise, such as food products retained in a grocery store retail freezer. Such shelves are inclined from back to front so that the goods move by gravity to the front of the shelf as they are removed therefrom by the consumer. Studies have shown that products are much more likely to be sold if the front of the shelf always has product.

A problem with metal shelves concerns the coefficient of friction between the shelf and certain products wherein a greater angle of inclination can be required to assure that a further product will always slide by gravity to the front of the shelf to replace one that has been removed. However, the greater the shelf angle the less product that can be stored in a given space. One approach to avoiding a greater angle of incline has been to make the shelf from a plurality of rigid wires or rods, rather than a sheet of metal, to decrease the total friction by minimizing the amount of physical contact between the product and the shelf. A further approach has involved the use of alternate lower coefficient of friction plastic materials to form the shelf. However, problems arise with respect to material suitability in terms of durability and tooling and material costs. Sheets of low friction material having a plurality of top surface parallel ridges are also known. These sheets can serve as the bottom of a shelf wherein the ridges run from the front to back thereof. Thus, in addition to reducing friction as a function of the physical properties of the material, such sheets also minimize the amount of surface area contact between the product and itself by virtue of the product only being in contact with the apex of the ridges. However, this approach also has problems with respect to manufacturing, and material and tooling costs.

Accordingly, it would be desirable to have a self-facing shelf that provides for reduced friction between the shelf and product, that is durable and that is relatively inexpensive to manufacture and use.

It is also understood that refrigerated food display freezers are made by a number of manufacturers, each having a slightly different shelf width. Thus, retrofitting such freezers with specially designed shelves for the display and sale of a certain product requires a specific adaptation for each freezer model. Such adaptations can be expensive and require a greater inventory of part types as well as greatly increase the chances of ordering, production or shipping errors occurring. Accordingly, it would be desirable to have a strategy for permitting the manufacture of one size of such a specialty shelf that could be used in any of the various freezers that would be encountered.

SUMMARY OF THE INVENTION

The present invention is a self-facing shelf slide for snap-fitting engagement with the parallel wires of a metal self-facing shelf. The slides are circular shaped in cross-section and preferably made of a co-extruded high density low friction plastic, such as polystyrene impregnated with silicone. The slides have a smooth top surface or one or more ridges thereon for facing and supporting the products thereon.

In operation, the slides are snap fitted onto individual wires of a metal shelf. In this manner, the friction between the wires and the product are substantially reduced by virtue of both minimizing contact between the product and the shelf and the low friction nature of the slide material. Moreover, it can be appreciated that the advantages of low cost, durability and ease of tooling can be retained by using metal wire shelves as forming the major structural portion of the shelf. In addition, a low overall cost can be maintained as the extruded slides serve to greatly minimize the amount of plastic used to accomplish the friction reduction in comparison with other prior art friction reducing strategies. A further cost savings can be realized by retrofitting existing metal wire shelves with the slides of the present invention.

In a further aspect of the present invention, a universal adapter frame for support of a plurality of specialty shelves is shown. The adapter includes a pair of vertically oriented shelf supports secured together by a plurality of spacer channels. Each spacer channel has a horizontal slot therein for slidingly cooperating with a securing means of a support bracket. In operation, the support brackets are secured to the vertical shelf rails of the freezer. The vertical supports are then centered there between the existing support rails of the freezer as the securing means can slide in the horizontal slots of the spacer channels. The securing means are then tightened so that the vertical supports can be held firmly in an upright position against the brackets. The specially designed shelves can than be secured to the additional support rails. Thus, after engaging the support brackets with the existing shelf support rails, the position of the frame vertical supports can be adjusted to fit the particular specialty shelf. In this manner the adapter frame can provide for the support of a particularly sized specialty shelf in a wide range of commercial freezers that would otherwise all require differently sized shelves.

Air flow baffles are also shown and comprise vacuum formed sheets of clear plastic having a plurality of ridges on the under side thereof. The baffles fit between shelf supports and a product shelf supported thereon. The baffles reduce air flow and serve to resist the formation of frost on refrigerated products.

DESCRIPTION OF THE DRAWINGS

A further understanding of the structure and operation, objects and advantages of the present invention can be had by referring to the following detailed description which refers to the following figures, wherein.

DETAILED DESCRIPTION OF THE PRESENT INVENTION

Figure 1:
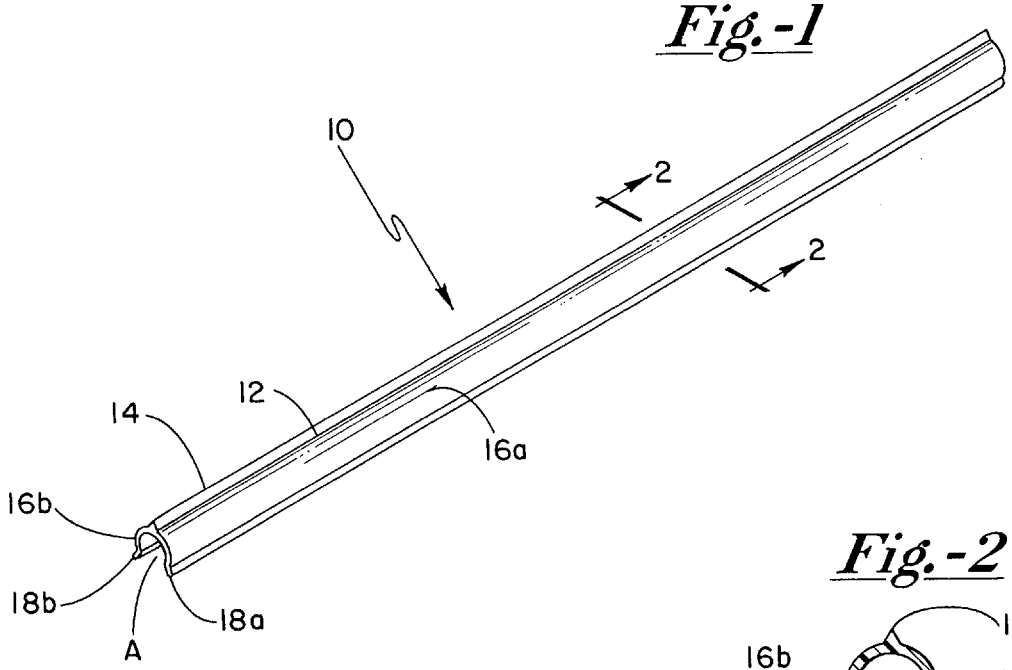
FIG. 1 shows a perspective view of a slide of the present invention.
Figure 2:
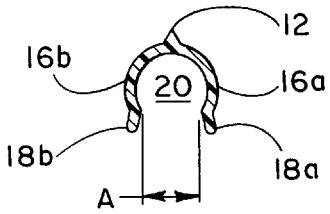
FIG. 2 shows an end plan cross-sectional view along lines 2—2 of FIG. 1.

A shelf cap or slide 10 is seen in FIG. 1, and generally referred to by the numeral 10. Slide 10 has a ridge 12 having a top edge 14. As seen by also referring to FIG. 2, slide 10 is circular shaped in cross section and includes legs 16*a* and 16*b*. Legs 16*a* and 16*b* include rounded ends 18*a* and 18*b*, and define a wire retaining area 20. Ends 18*a* and 18*b* are spaced apart by a distance A suitable for providing a snap-fitting engagement over a shelf wire 22 shown in phantom.

Figure 3:
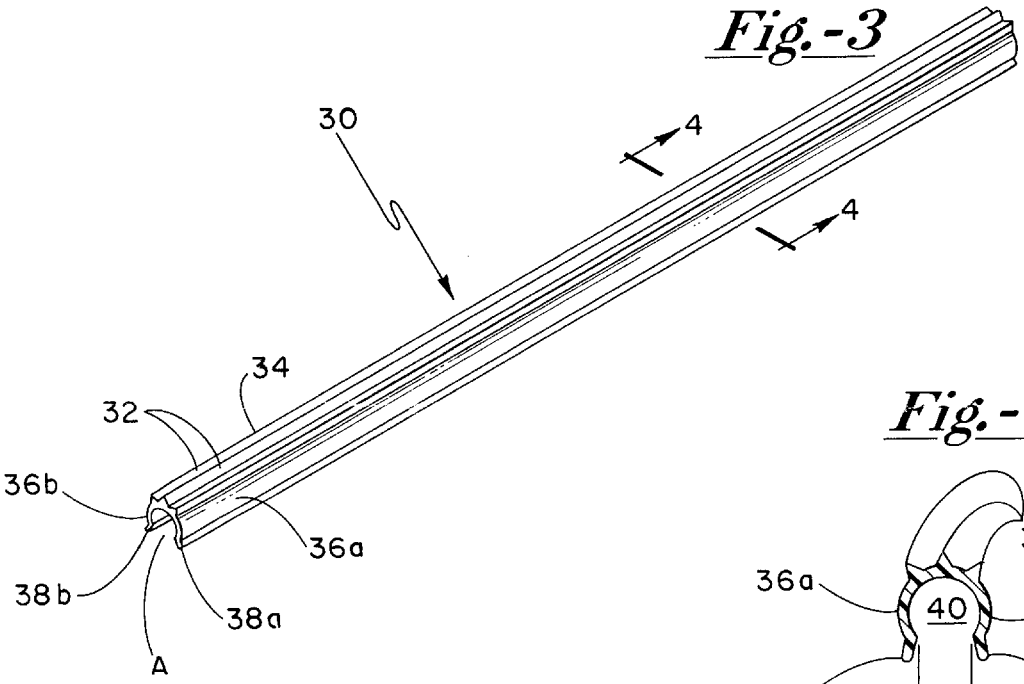
FIG. 3 shows a perspective view of an alternate slide embodiment of the present invention.
Figure 4:
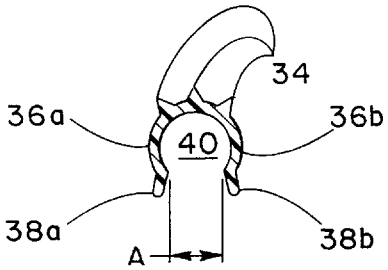
FIG. 4 shows an end plan cross-sectional view along lines 4—4 of FIG. 3.
Figure 5:
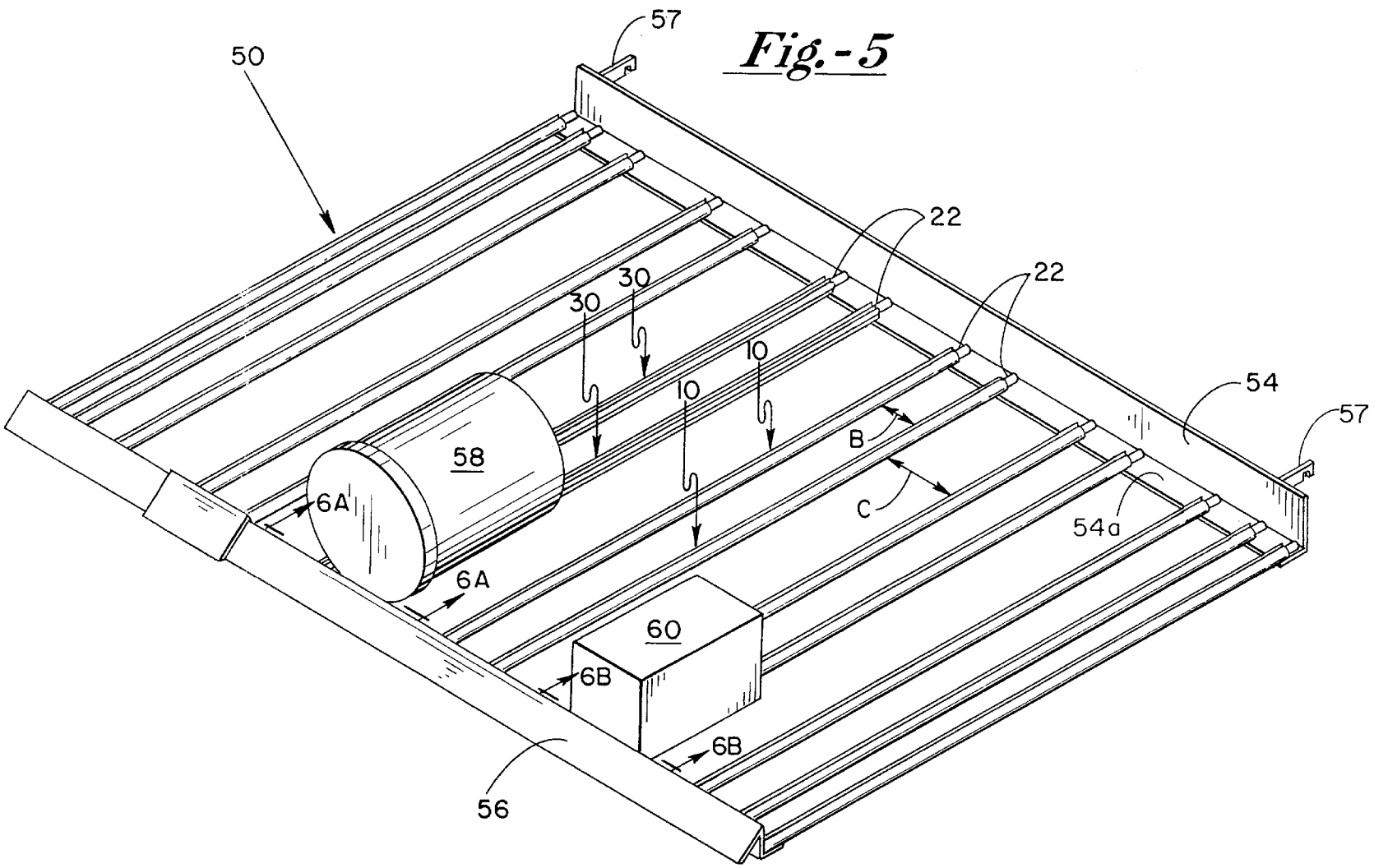
FIG. 5 shows an environmental perspective view of the slides of the present invention secured to a wire shelf.
Figure 6A:
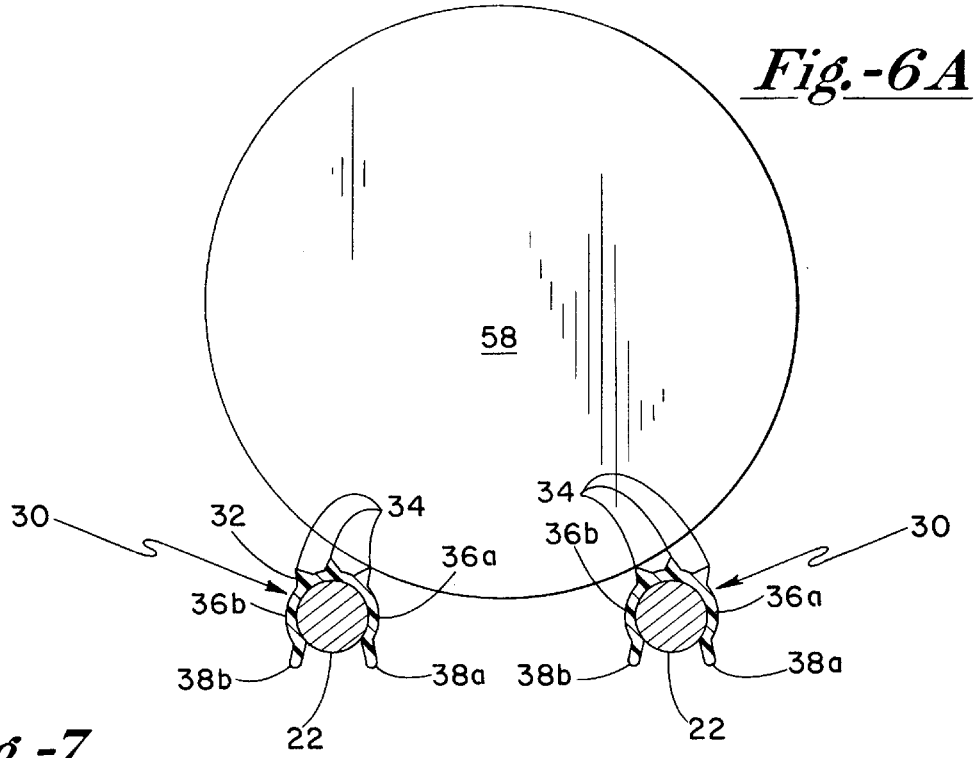
FIG. 6A shows an end plan cross-sectional view along lines 6A—6A of FIG. 5.

An alternate embodiment of the cap or slide of the present invention is seen by referring to FIGS. 3 and 4. Slide 30 has a plurality of ridges 32 having a top edges 34. Slide 30 is circular shaped in cross section and includes legs 36*a* and 36*b*. Legs 36*a* and 36*b* include rounded ends 38*a* and 38*b*, and define and a wire retaining area 40. Ends 38*a* and 38*b* are spaced apart by a similar suitable distance A.

Figure 7:
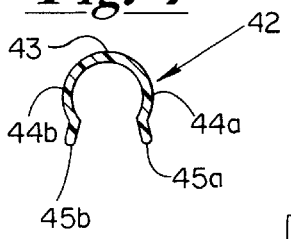
FIG. 7 shows a cross-sectional view of a further embodiment of the shelf slide of the present invention.
Figure 6B:
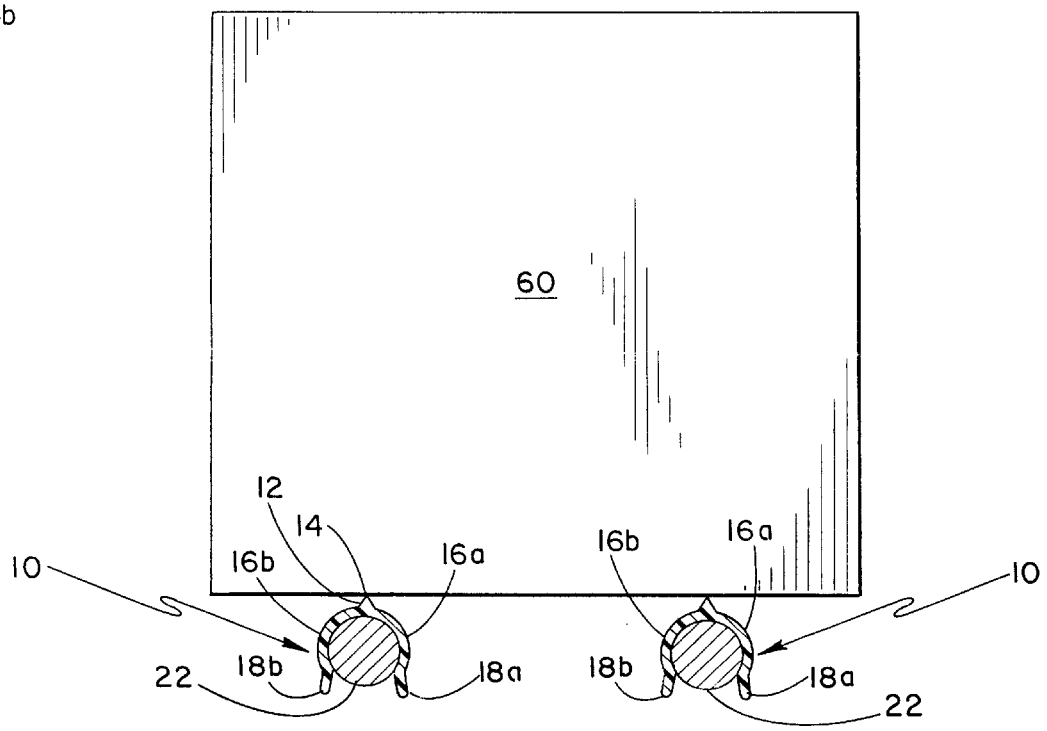
FIG. 6B shows an end plan cross-sectional view along lines 6B—6B of FIG. 5.
Figure 8:
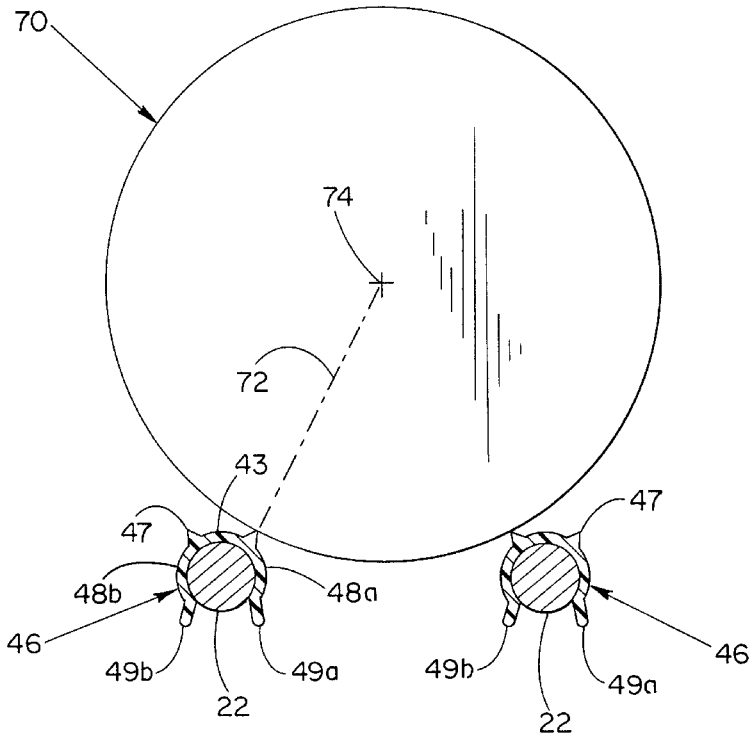
FIG. 8 rows a cross-sectional view of a further embodiment of the self slide of the present invention.
Figure 9:
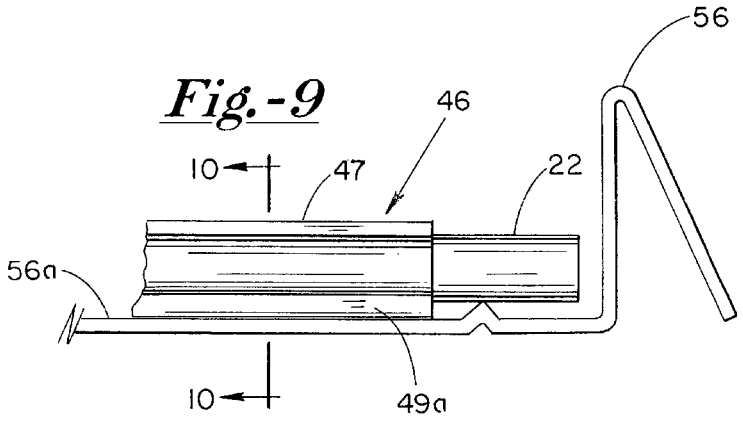
FIG. 9 shows a side plan cross-sectional view of a shelf at the front bracket end.
Figure 10:
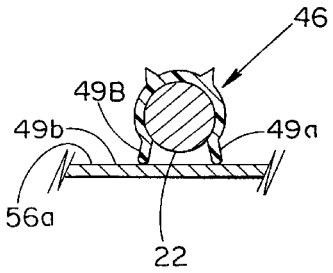
FIG. 10 shows a cross-sectional view along lines 10—10 of FIG. 9.

A further embodiment of the shelf slide of the present invention is seen in FIG. 7, and generally referred to by the numeral 42. Slide 42 has a smooth ridgeless top surface 43, a pair of legs 44A and 44B and leg ends 45A and 45B. A further embodiment of the shelf slide of the present invention is also seen in FIGS. 8–10, and generally referred to as the numeral 46. Slide 46 includes a pair of ridges 47, legs 48A and 48B, and leg ends 49A and 49B. It will be understood that slides 42 and 46 are made in the same manner as slides 10 and 30 with exception of the different number of ridges and/or smooth top surface.

As seen in FIGS. 5, 6A, 6B and 8–10, a shelf 50 includes a plurality of parallel support wires 22 extending between and secured to a rear mount bracket 54 and a front mount bracket 56. In particular, brackets 54 and 56 include flat horizontal portions 54*a* and 56*a* respectively. Slides 10, 30, 42 and 46 are sized to be snap-fitted to wires 22 wherein the ridges or top smooth surface thereof face the product to be loaded onto shelf 50. Moreover, slides 10, 30, 42 and 45 are cut to a length such that when secured to wires 22 the ends thereof overlap bracket flat portions 54*a* and 56*a*. As seen in FIGS. 9 and 10, it can be understood that any tendency for twisting of a slide around a wire 22 that could otherwise occur is prevented. Specifically, the leg ends of each slide, in the particular example as seen in FIGS. 9 and 10 leg ends 49A and 49B of slide 46, rest on flat surfaces 54A and 56A and thereby prevent the rotation of the slide around wire 22.

Wires 22 can be spaced apart by any desirable distances B or C to provide for accommodating variously sized and shaped products. As seen in FIG. 6, a round product 58 or flat product 60, for example, can be placed on shelf 50. It can be appreciated that the multiple ridges 32 of slides 30 can serve to provide the desired linear or minimal surface area contact low friction support for an object. It was surprisingly discovered that slide 42 having a smooth ridgeless top surface 43 has particular utility in supporting objects being displayed in a frozen compartment, such as ice cream containers. Such containers, over time, can form a layer of ice over the surface thereof, and such ice can act to adhere the container to any shelf it is in contact with during that ice formation. Smooth surfaced slide 42 is apparently particularly resistant to such ice adhesion. It is thought that the smooth surface 43 provides less of an opportunity for ice to freeze on to or around it in a manner that would result in such adhesion, mechanical or otherwise, that could prevent product movement there along.

As seen in FIG. 8, slide embodiment 46 includes ridges 47 wherein such ridges are ideally oriented with respect to a round container 70 such that each of two ridges 47 on opposite parallel extending slides 46 in contact therewith extend or point along a line 72 extending through ridges 47 to the center 74 of container 70. It will be appreciated that the positioning of wires 22 is coordinated with the positioning of ridges 47 on the surface of slide 46 with respect to the diameter of container 70 such that the weight of container 70 is projected linearly along line 72 as it extends through slides 46 and wires 22. In this manner, it can be appreciated that no torque is provided to either slide 46 thereby also reducing the tendency for slides 46 to rotate about wires 22. It can also be appreciated that the snap fitting of a slide of the present invention provides for releasable attachment to a shelf wire, whereby, if the slide is damaged or worn can be removed and replaced with a new slide.

Figure 11:
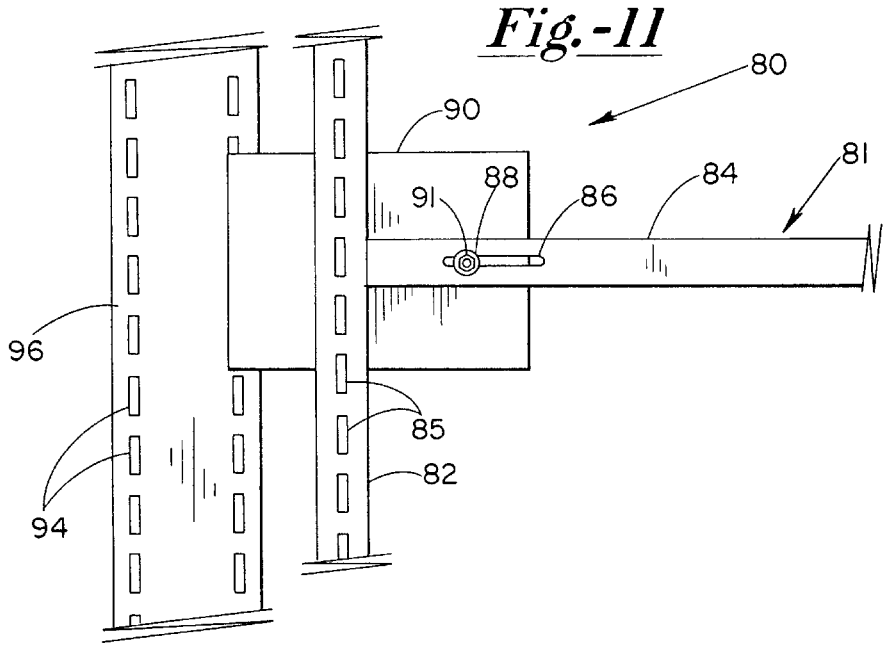
FIG. 11 shows a partial front plan view of the shelf adapter.
Figure 12:
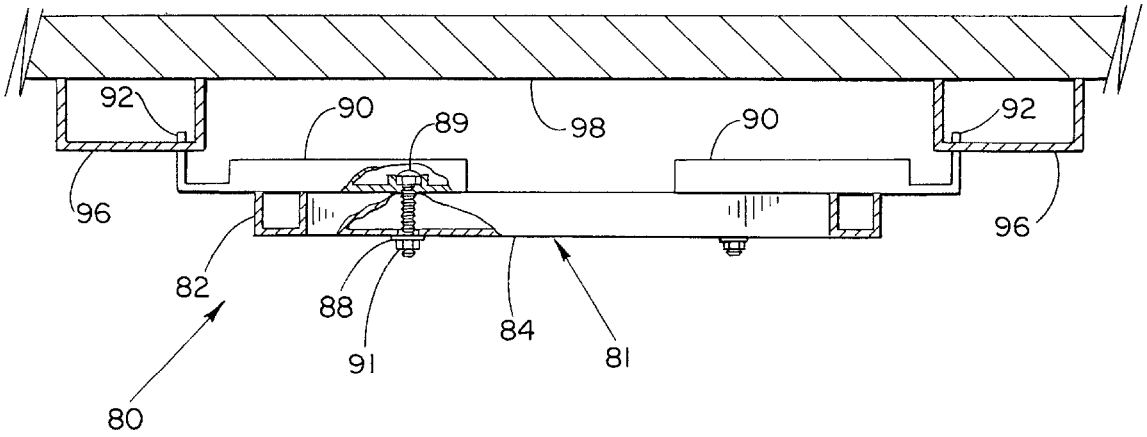
FIG. 12 shows a top plan cross-sectional view of the shelf adapter.

As seen in FIGS. 11 and 12, a shelf adapter is shown and generally indicated by the numeral 80. Adapter 80 includes a frame 81 consisting of a pair of U-shaped shelf supporting channel rails 82 extending vertically and parallel to each other and secured together by one or more horizontally extending U-shaped channel spacers 84 welded thereto. Rails 82 include shelf foot retaining slots 85, and channels 84 include adjustment slots 86 through which a carriage bolt 88 extends. In particular, each bolt 88 includes an end 89, for example, of the carriage bolt type for retaining thereof in a bracket 90. Each bolt 88 extends through its respective bracket 90, and, as stated, through a corresponding slot 86, and includes a nut 91. Brackets 90 include hook, or foot ends 92, as is well known in the art, for releasably securing with slots 94 of shelf support rails 96. Shelf support rails 96 extend vertically and constitute part of the original shelf support structure provided in a refrigerated freezer 98.

In operation, brackets 90 are secured to supports 96 of freezer 98. Frame 81 is initially loosely secured to brackets 90, wherein after the positioning of brackets 90 and centering of frame 81, bolts 88 are tightened thereby securing channel spacers 84 to brackets 90. It will be appreciated by those of skill that slots 86 provide for the centering of frame 81 between the existing freezer shelf supports 96. After shelf support frame 81 is centered and secured in place, a shelf 50 can then be secured to shelf support rails 82 by insertion of foot ends, not shown, and, for example extending from a rear surface of rear bracket 54, into slots 85. Of course, various other attachment means are known in the art for providing securing of a shelf to rails 82, or of brackets 90 to rails 96 other than through the use of a slot and hook. It can be appreciated that adapter 80 provides for the application of a shelf, such as shelf 50, or other support means, for use in any of a wide variety of commercially available refrigerated display cabinets. In other words, shelf 50, or any particularly designed shelf or support means, can be manufactured in one size, and, through the use of adapter 80, can be utilized in any of the commercially available refrigerated display cabinets regardless of the spacing of the existing shelf support bars 96 therein.

Figure 13:
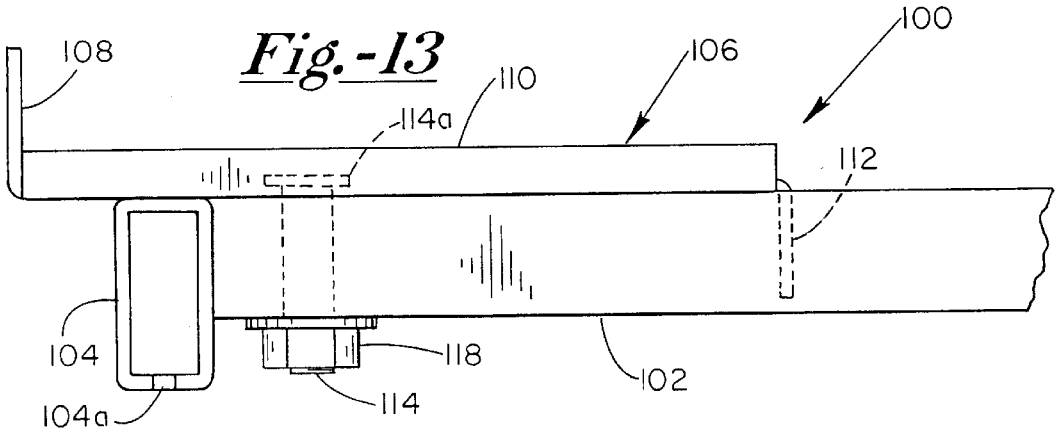
FIG. 13 shows a top plan view of an alternate frame adapter embodiment.
Figure 14:
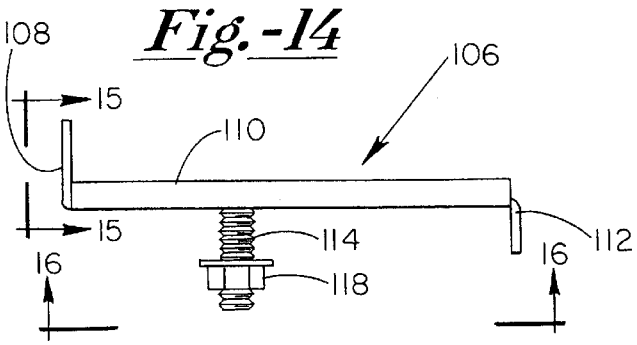
FIG. 14 shows a top plan view of a bracket of the present invention.
Figure 15:
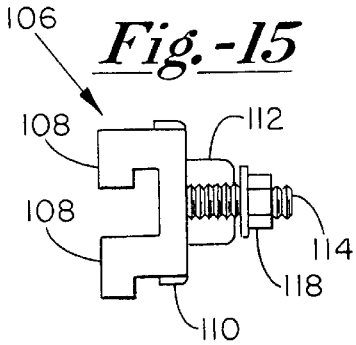
FIG. 15 shows a side plan view along lines 15—15 of FIG. 14.
Figure 16:
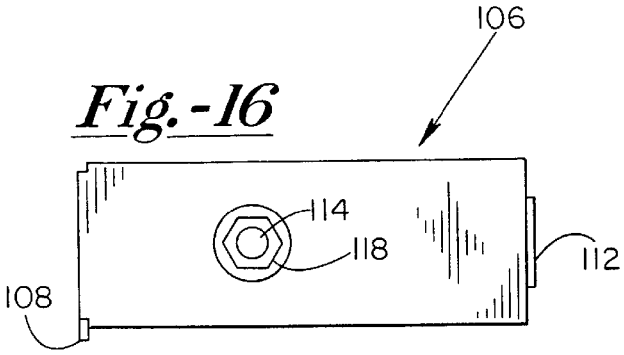
FIG. 16 shows a front plan view along lines 16—16 of FIG. 14.

A further shelf adapter embodiment 100 is seen in FIGS. 13—22. As seen particularly in FIG. 13, shelf adapter 100 includes, as with U-shaped channel 84 of adapter 80, a U-shaped channel horizontal spacer 102. Adapter 100 also includes a pair of vertically extending shelf support tubes 104 welded to spacers 102, and having a plurality of tab receiving slots 104*a*. Shelf support tubes are analogous to U-shaped channels 82, but are tubular and are narrower in their width dimension for providing greater proportional strength and the use of less space which permits an increased shelf width. Frame 100 also includes modified brackets 106. As seen by referring to FIGS.14–16, brackets 106 each include hooked tabs or foot ends 108, a shallow U-shaped channel portion 110, a tab portion 112, and a bolt 114 having a head end 114*a* secured within channel portion 110. Bolt 114 extends through channel portion 110 and through a slot 116 of spacers 102. A ridged flange lock nut 118 is threadably engaged on bolt 114 and provides for adjustable securing of spacer channel 102 to brackets 106. As seen in FIG. 13, when bracket 106 is tightly secured to horizontal channel 102, the integral tab portion 112 thereof, extends into the U-shaped channel of spacer 102.

Figure 17:
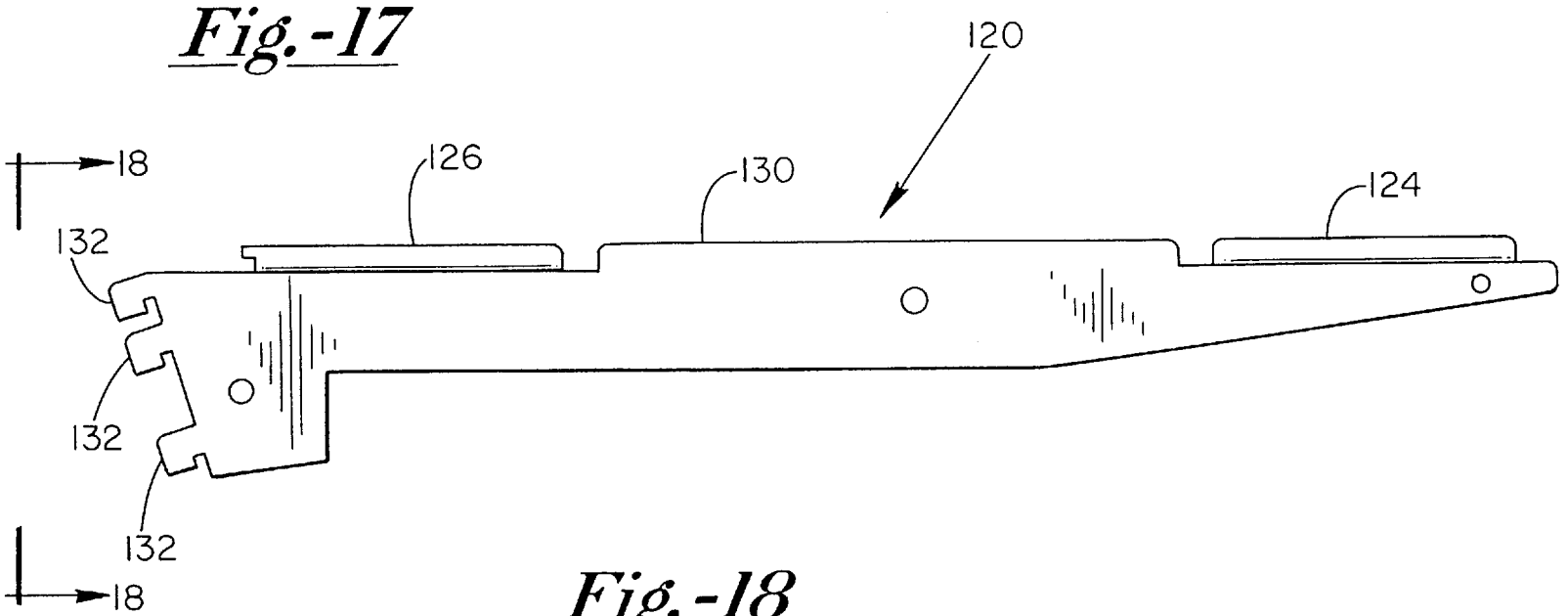
FIG. 17 shows a shelf bracket side plan view.
Figure 18:
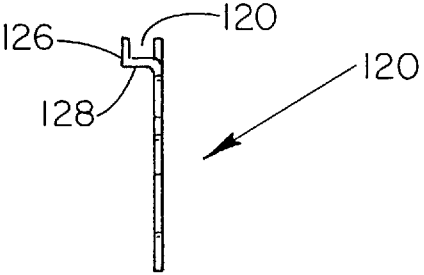
FIG. 18 shows an end view along lines 18—18 of FIG. 17.
Figure 19:
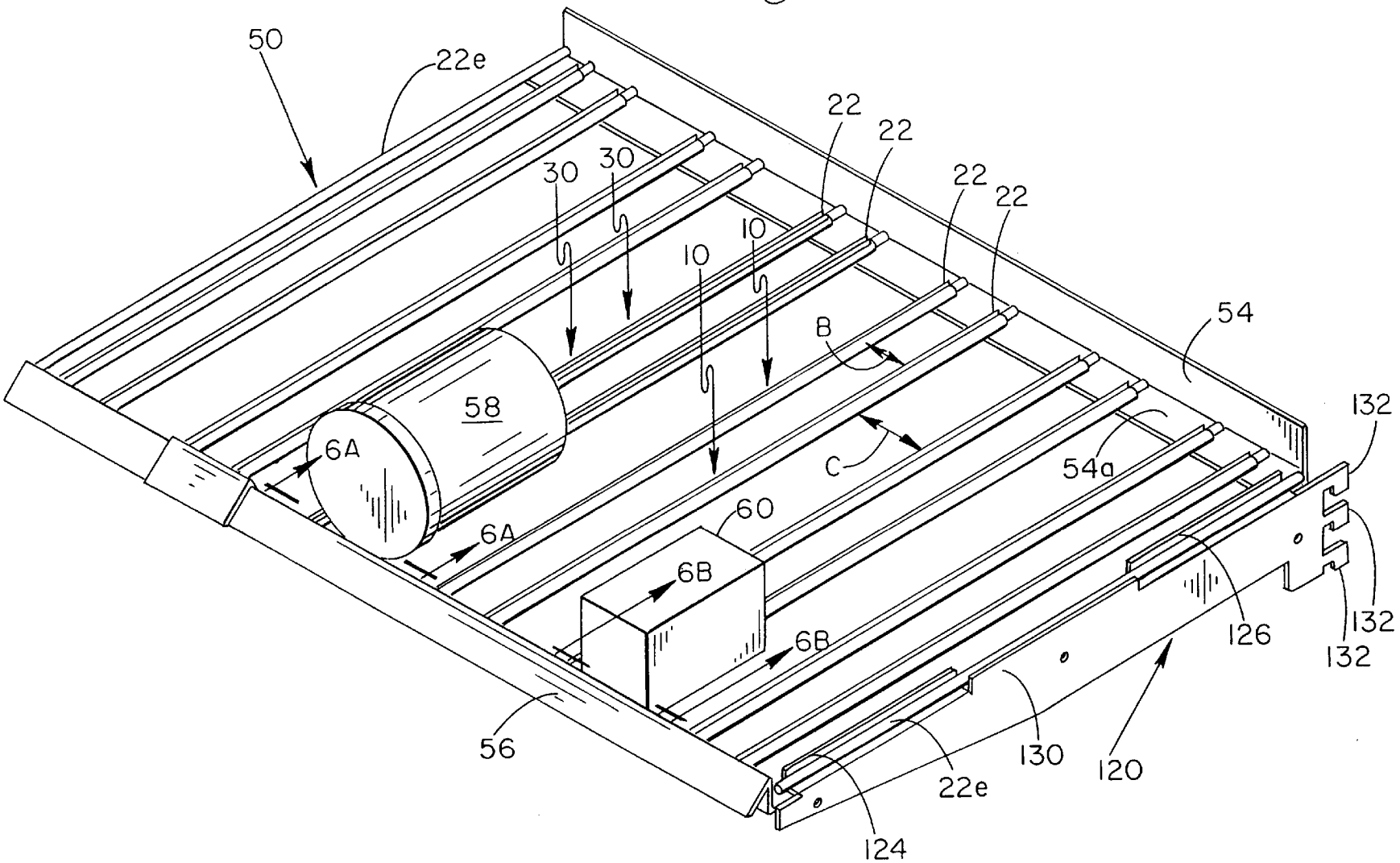
FIG. 19 shows a perspective view of a shelf of the present invention.
Figure 20:
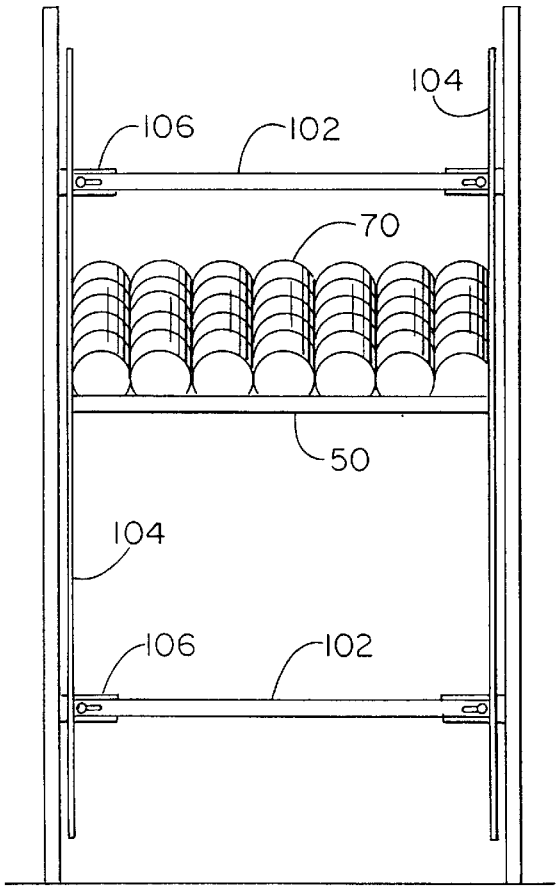
FIG. 20 shows a front plan environmental view of a shelf and adapter frame.
Figure 21:
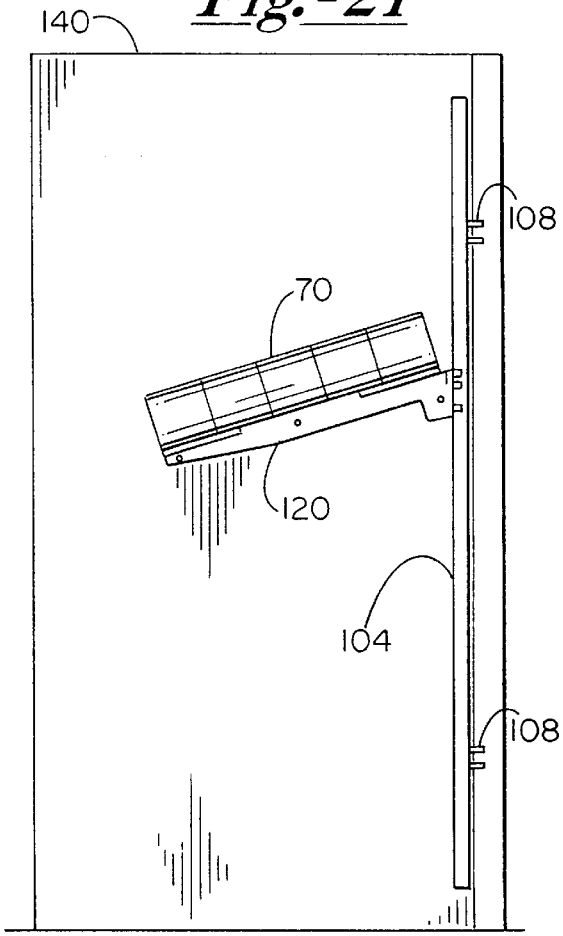
FIG. 21 shows a side plan environmental view of a shelf and adapter frame.
Figure 22:
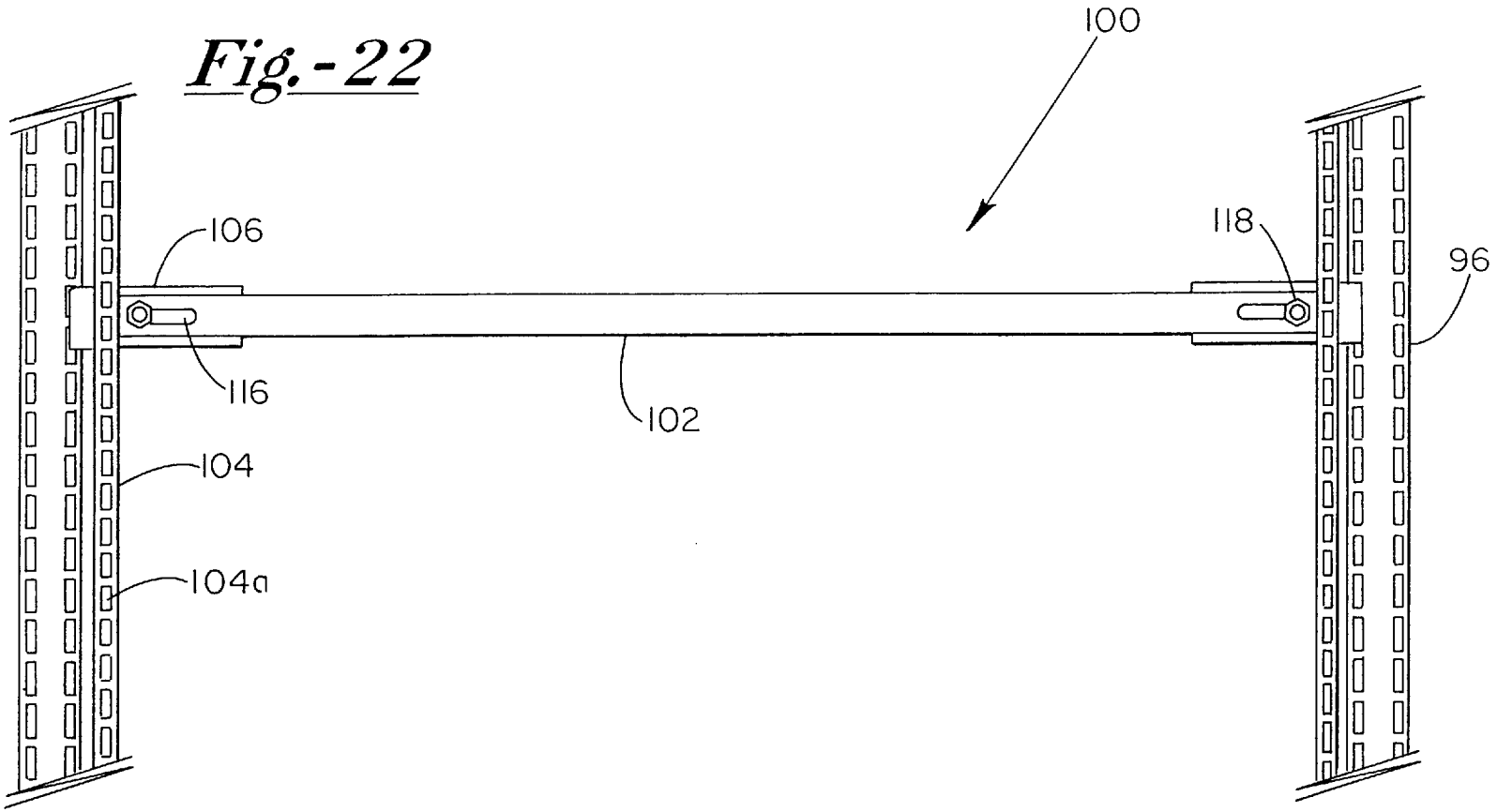
FIG. 22 shows an enlarged detail of FIG. 20.
Figure 23:
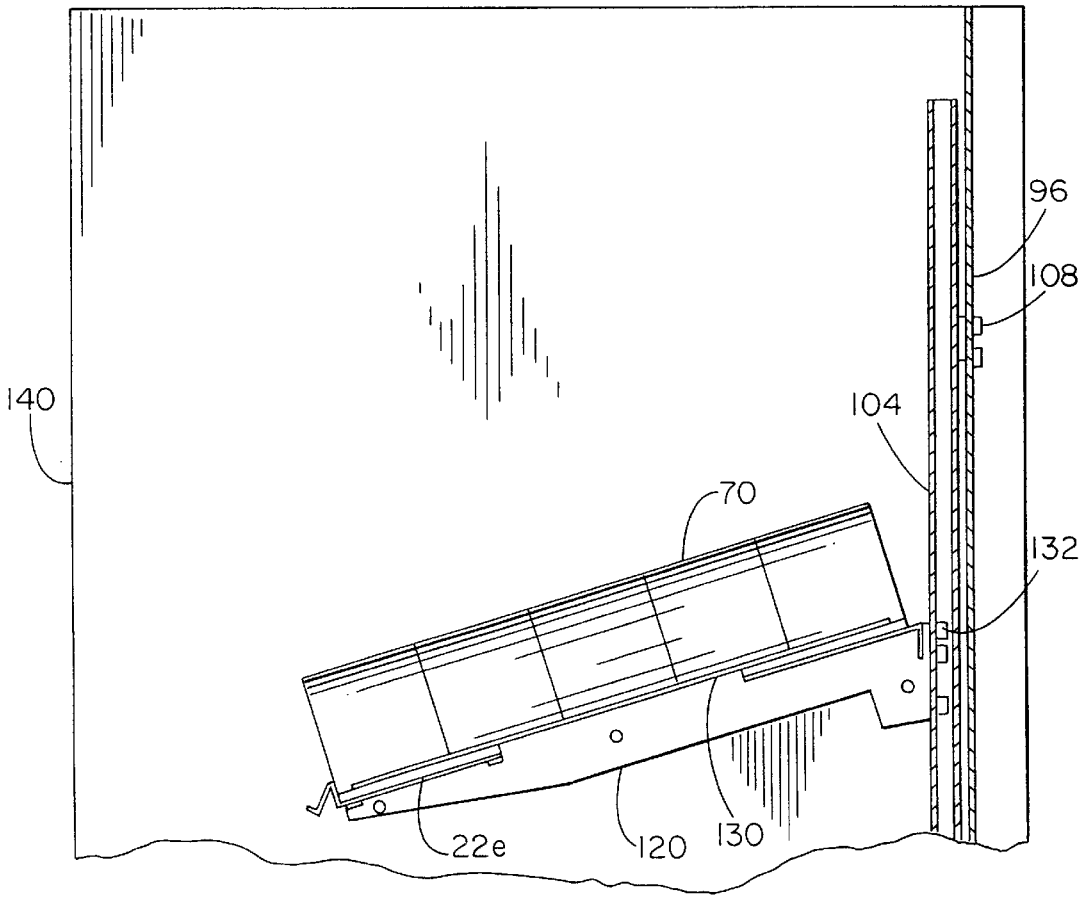
FIG. 23 shows and enlarged detail of FIG. 21.

Referring to FIGS. 17–19, an alternate means of suspending shelf 50 is seen and includes a shelf support brackets 120. Brackets 120 each include a wire receiving channel 122 defined by upright extending front and rear tabs 124 and 126 respectively each having a horizontal bottom portion 128, and a central tab 130. Brackets 120 include three hooked foot ends 132 for insertion into slots 104*a*.

As can be understood by referring to FIG. 19, two brackets 120 are secured to each shelf 50. Specifically end wires 22*e* do not have friction reducing slip caps secured thereto. Thus, end wires 22*e* can be inserted into channels 122 of brackets 120 for releasable engaging of shelf 50 with brackets 120. As seen by referring to FIGS. 20–23, bracket foot ends 132 are inserted into slots 104*a* and provide for support of one or more shelves 50 on adapter frame 100. In the same manner as with frame 80, brackets 106 of frame 100 can be variably positioned along horizontal channels 102 by the particular positioning of bolts 114 in slots 116. Thus, as with adapter frame 80, the width of frame 100 can be adjusted to adapt to the particular spacing of the original shelf supports 96 as placed in a refrigerated cabinet 140 of various refrigerated display cabinet manufacturers. An advantage of frame 100 concerns bracket 106 and the tab 112 thereof. It will be appreciated by those of skill that tab 112 by insertion into the channel of horizontal spacers 102, resists any undesired movement or twisting of frame 100. As tab 112 is sized just slightly smaller than the cross-section of the U-shaped channel 102, there exists very little room for movement of bracket 106 with respect to channel 102 when it is tightly secured thereto. Thus, this bracket and horizontal channel interaction or locking of adapter frame 100 provided by bracket 106 and channel 102 was found to provide for a much more secure and rigid shelf support, particularly where many shelves holding heavy loads of product were being supported by frame 100. As seen in FIGS. 20–23, frame 100 is seen in a cabinet 140 and includes a representative shelf 50 having products 70 thereon, and supported by brackets 120. Frame 100 typically includes two horizontal spacers 102 for providing adequate shelf frame rigidity.

Figure 24:
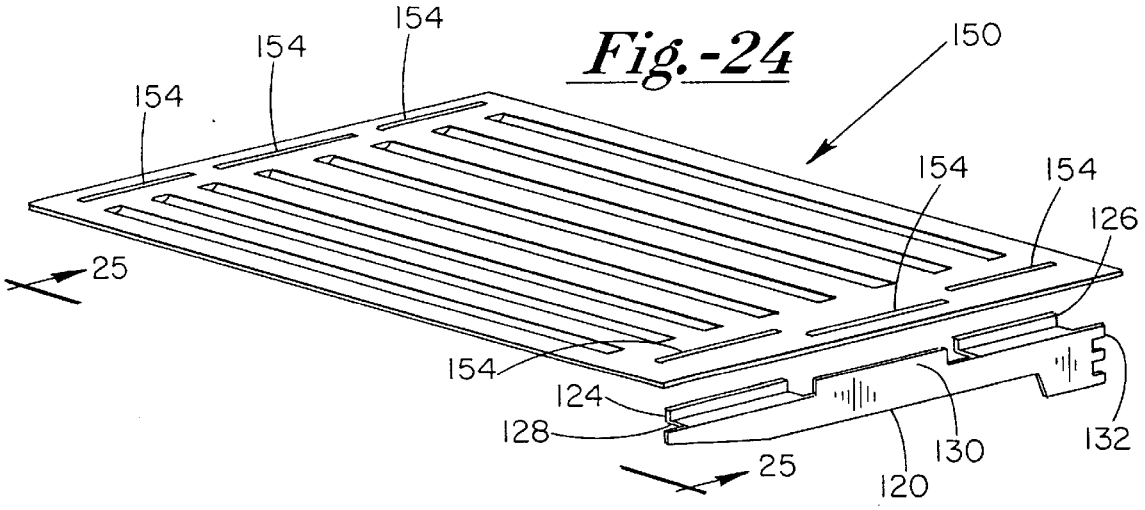
FIG. 24 shows a perspective view of an air baffle of the present invention.
Figure 25:
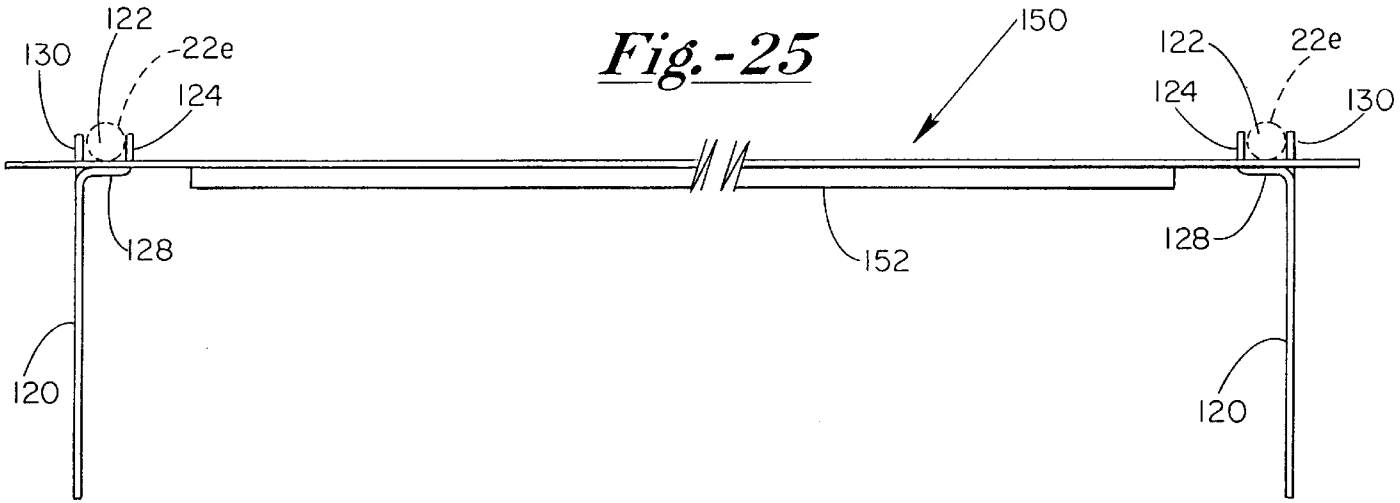
FIG. 25 shows an end view along lines 25—25 of FIG. 24.

As seen in FIGS. 24 and 25, an air flow baffle 150 comprises a clear sheet of vacuum formed plastic having a plurality of ridges 152 extending from a bottom side thereof. Each baffle 150 includes three slits 154 along each side end thereof. The slits 154 are positioned so that tabs 124, 126 and 130 of brackets 120 can extend there through. As understood by specifically referring to FIG. 25, baffle 150 is first positioned on brackets 120, after which a shelf 50 is then placed on supports 120 in the normal manner wherein end wires 22*e* reside in channels 122 Thus, it can be appreciated that shelves 50 serve to retain baffles 150 on supports 120. Ridges 152 provide for structural rigidity of baffle 150. Baffles serve to limit air flow between and around shelves 50. This ability was found to reduce the formation of frost on the particular refrigerated goods. The reduction of frost formation is very desirable as the products are more readily identified by the shopping consumer making product selection an easier and less time consuming process. As an offshoot thereof, the doors of the particular refrigerated cabinet are generally not held open as long. Thus, less energy is needed to cool the refrigerated cabinets resulting is greater energy efficiency and lower energy cost.

Figure 26:
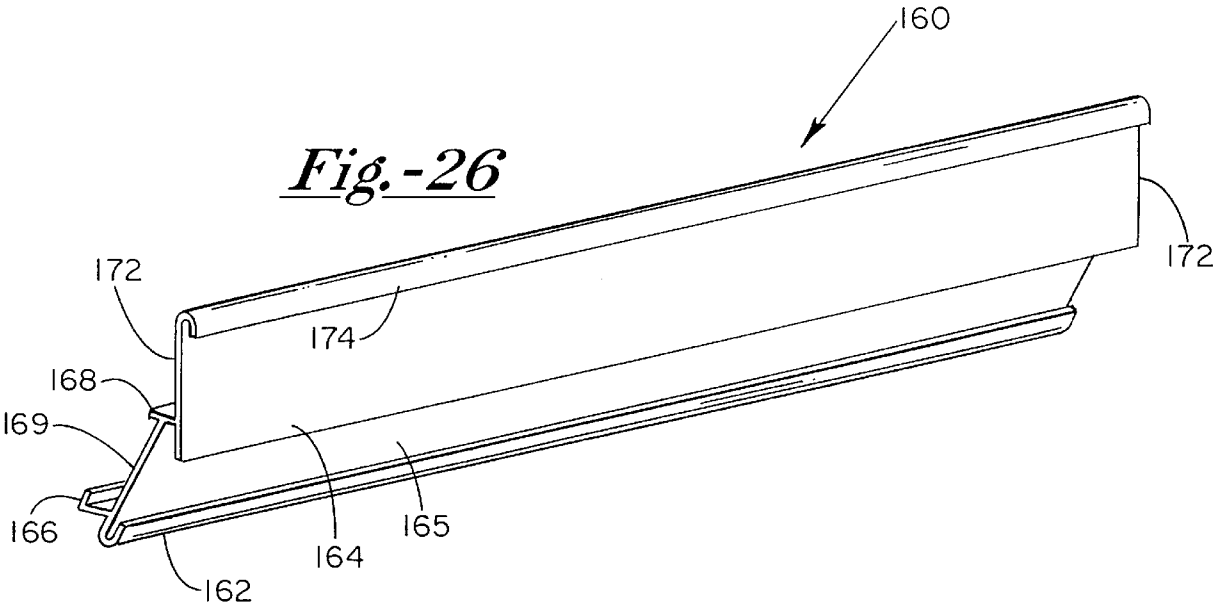
FIG. 26 shows a perspective view of an end cap of the present invention.
Figure 27:
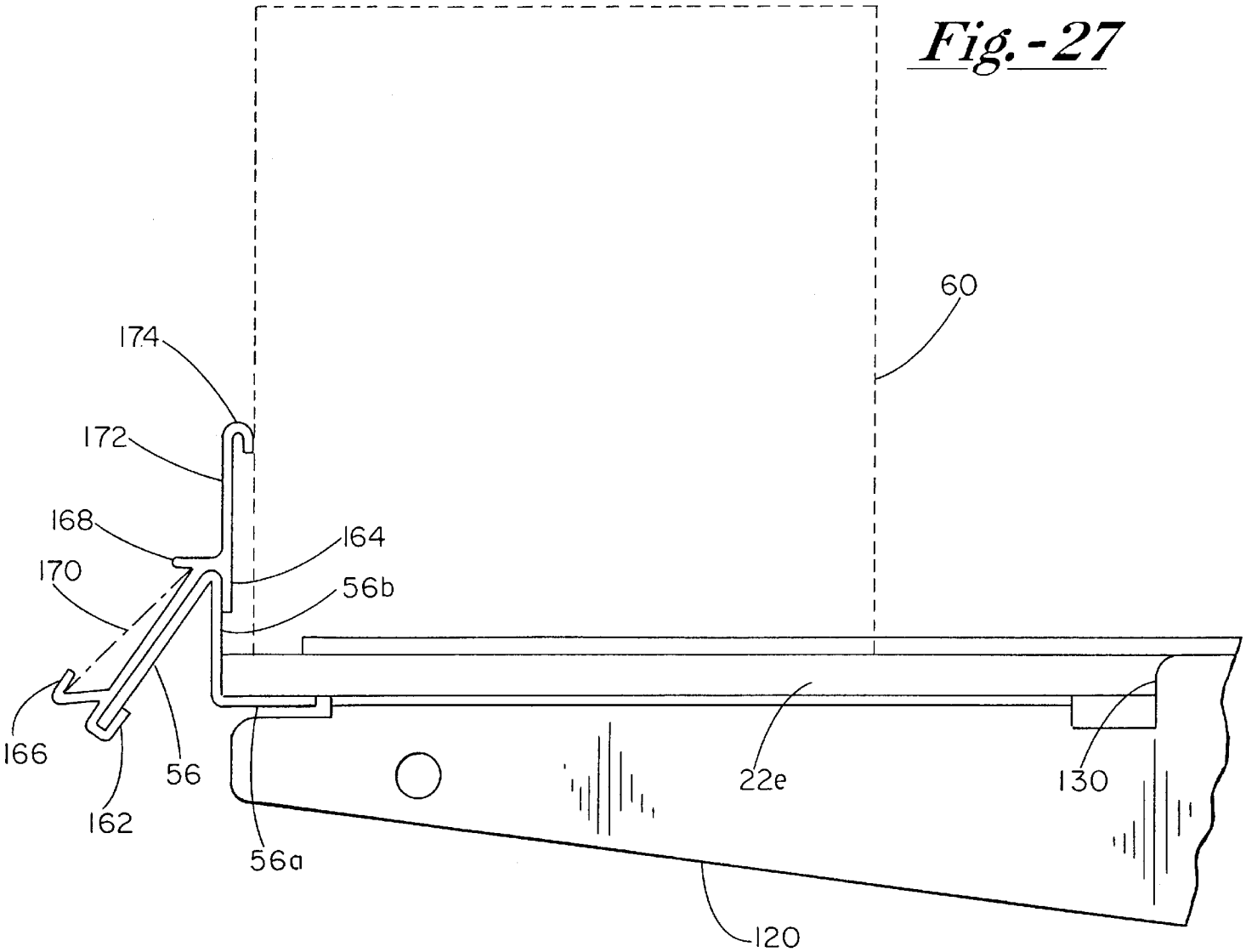
FIG. 27 shows an end plan view of an end cap and shelf.

Referring to FIGS. 26 and 27, a price display extrusion 160 is shown. Cap 160 is a clear plastic extrusion having tabs 162 and 164 defining a channel 156 for providing securing to front end bracket 56, and tabs 166 and 168 defining a channel 169 for providing for the retention of a price indicating tag 170. End cap 160 also includes a vertically extending portion 172 having a radiussed extension 174. In operation, as understood by referring particularly to FIG. 27, cap 160 is slipped onto bracket 56 whereby bracket 56 is retained in channel, after which a price tag 170 can be inserted into channel 169. Vertical portion 172 with extension 174 provide for added retention of a product, such as the cubical or "brick" shaped product 60. With such products, it was found that having additional height above that normally represented by the height of front bracket vertical portion 56*b*, can be desirable. Specifically, after a product is removed, the product behind it slides forward to face up against bracket 56. However, with some products, and in particular brick shaped products, there can be a tendency for the product to hit bracket vertical portion 56*b* wherein its momentum can cause it to rotate or "flip" over bracket 56 and fall off shelf 50. From the perspective of FIG. 23, the object can be understood to move from right to left and rotate in a counterclockwise manner over the top of bracket portion 56*b*. This tendency is reduced by providing for a greater height of front bracket portion 56*b*. However, there is a problem in that increasing the height of bracket portion 56*b* interferes with the ability of the consumer to see the product and to be able to easily grasp and remove the product from its shelf. It was surprisingly discovered that extension 174 serves to reduce this rotational tendency allowing the use of a proportionally lower profile vertical portion 172 than would be required without extension 172. It is believed that extension 174 operates to contact the product first rather than allowing it to hit vertical portion 172 in a flush manner, as would be the case without extension 174. By contacting the product at a point thereon generally above a mid-point thereof, the product is first made to move, again from the perspective of FIG. 23, in a clockwise rotation. It is thought that this initial clockwise movement serves to cancel or work against the tendency for counterclockwise movement so that the product can not flip over bracket 56. Thus, a lower profile blocking wall can be presented. The result is that vertical portion 172 with extension 174 extending therefrom in the direction of the product, can effectively retain products on a gravity fed shelf using less overall height than would be the case where vertical portion lacked extension 174, i.e. vertical portion 172 would have to be much longer to extend higher above the bracket 56 than would be the case with extension 174. It will be appreciated that various extension means could extend from vertical portions 172. The radiussed extension 174 is simply a cost effective way of providing an extension in that it is an integral part of the entire extrusion 160 and formed simultaneously therewith, Thus, the minimizing of the height of extension 172 makes the product easier to see and easier to remove from its shelf. Since cap 160 is clear, that also assists the consumer's ability to see the product. Additionally, cap 160 represents a much less expensive way to provide for this added height component as compared to increasing the height of bracket 56 itself, which is typically made of metal. However, it will be appreciated by those of skill that various means for providing a vertical block or stop wall having a rotation countering extension extending therefrom could be attached to bracket 56 or made an integral portion thereof.

Figure 28:
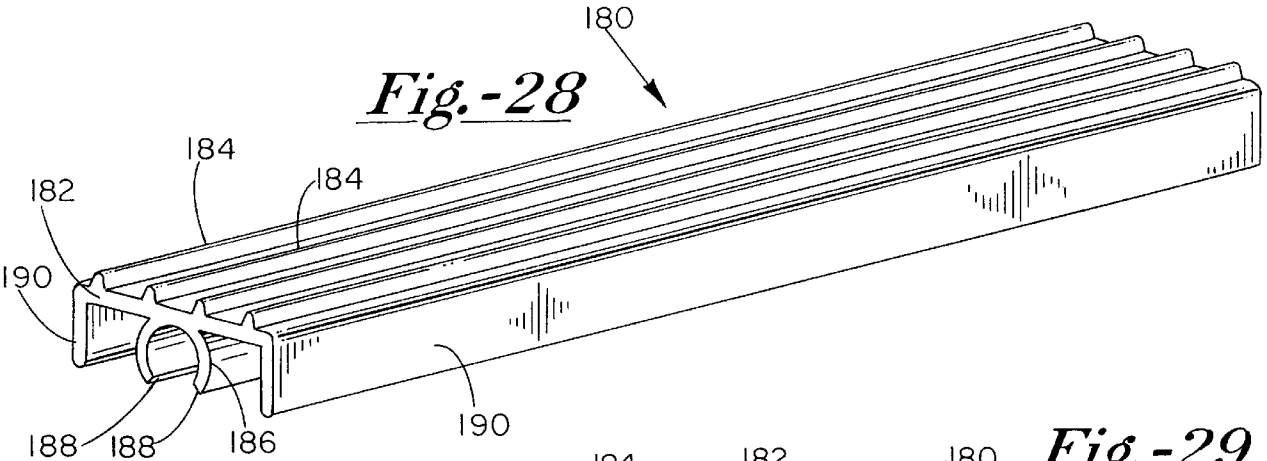
FIG. 28 shows a perspective view of an alternate slip cap embodiment.
Figure 29:
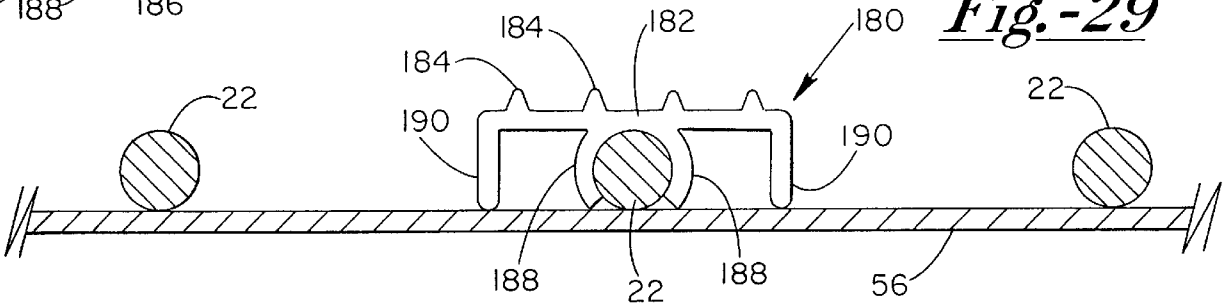
FIG. 29 shows an end cross-sectional view of the slip cap of FIG. 28 secured to a shelf.
Figure 30:
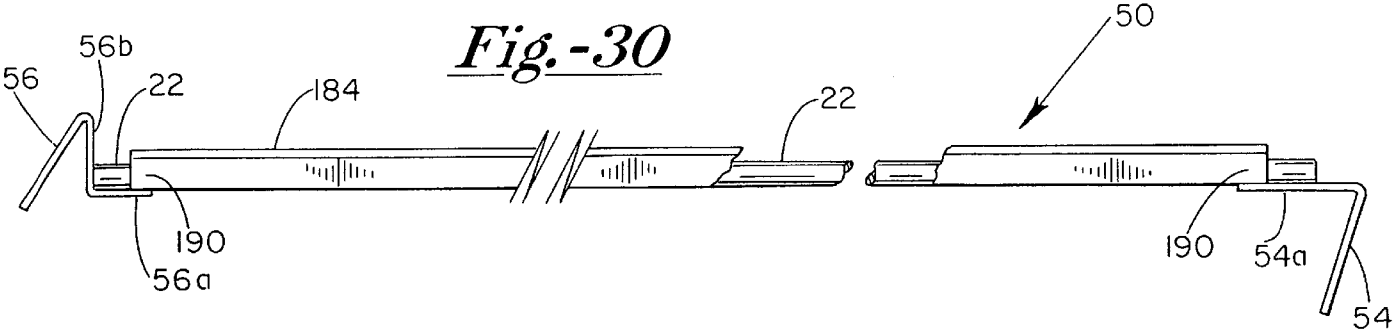
FIG. 30 shows a side plan view of the slip cap embodiment of FIG. 28 on secured to a shelf.

As seen in FIGS. 28–30 an alternate slip cap embodiment 180 is shown. Slip cap 180 is extruded from the same material as the previously discussed embodiments, wherein polystyrene is coextruded with silicone wherein the silicone is impregnated into the top or product contacting part of the cap. Typically the silicone will comprise 2 to 10% of the top portion of the slip cap. Cap 180 includes a top planar portion 182 having a plurality of surface area friction reducing ridges 184 extending therefrom. Cap 180 also includes an attachment means comprising a round channel 186 defined by two arcuate legs 188 integral with and extending from a bottom surface of planar portion 182. Two vertically extending end legs 190 are integral with planar portion 182. As seen in FIG. 29, a wire 22 is releasably retained within round channel 186. Thus, cap 180 extends over only one wire. As seen in FIG. 30, cap 180 extends substantially the full length of shelf 50 whereby end portions of legs 190 rest on front and rear brackets horizontal portions 56*a* and 54*a* respectively. In this manner any tendency of cap 180 to rotate around its individual wire is prevented. It will be appreciated by those of skill that the top planar portion 182 could be made of various widths depending on the spacing of wires 22. Thus, each cap 180 could be spaced from the nest adjacent one, or an essentially continuous planar surface could be had depending on the particular application.

It will be apparent to those of skill that various modifications can be made to the present invention, such as selection of materials, number of ridges, the number and orientation of the shelf wires and the like, without exceeding the spirit and scope thereof. Moreover, it will be understood by those of skill that the frame adapters, shelves and slides need not be limited solely to refrigerated freezer applications, but could be useful with a wide variety of display equipment and environments, whether refrigerated or not. In addition, the inventions herein have application to any types of products suitable for gravity type feed and display, regardless if the shapes thereof are regular or irregular.

What is claimed is:

1. A shelf slide for use on a shelf wherein the shelf includes a plurality of parallel product support wires extending between a front shelf bracket and a rear shelf bracket, the slide comprising:

a planar portion having a plurality of ridges extending from a top surface thereof, a single elongate wire attachment channel defined by two arcuate leg portions extending from a bottom surface of the planar portion for providing releasable attachment to a single shelf wire, a pair of end legs integral with and extending transverse from and along side edges of the planar portion so that when the slide is secured to a shelf wire, rotation thereof around the wire is prevented by contact of the end legs with front and rear brackets of the shelf.

* * * * *